US010465697B2

(12) United States Patent
Son et al.

(10) Patent No.: US 10,465,697 B2
(45) Date of Patent: Nov. 5, 2019

(54) CENTRIFUGAL FAN AND AIR CONDITIONER HAVING THE SAME

(71) Applicant: LG ELECTRONICS INC., Seoul (KR)

(72) Inventors: Minsu Son, Seoul (KR); Kiwon Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 630 days.

(21) Appl. No.: 14/879,132

(22) Filed: Oct. 9, 2015

(65) Prior Publication Data

US 2016/0108928 A1 Apr. 21, 2016

(30) Foreign Application Priority Data

Oct. 16, 2014 (KR) ..... 10-2014-0139922
Jan. 8, 2015 (KR) ..... 10-2015-0002894

(51) Int. Cl.
*F04D 29/28* (2006.01)
*F04D 29/42* (2006.01)
(Continued)

(52) U.S. Cl.
CPC ..... *F04D 29/283* (2013.01); *F04D 25/166* (2013.01); *F04D 29/4226* (2013.01);
(Continued)

(58) Field of Classification Search
CPC ..... H05K 7/20; F04D 29/42; F04D 1/00
(Continued)

(56) References Cited

U.S. PATENT DOCUMENTS 4,367,636 A 1/1983 Sakuma et al.
4,738,188 A 4/1988 Nishida
(Continued)

FOREIGN PATENT DOCUMENTS

| | | |
|---|---|---|
| CN | 1825009 | 8/2006 |
| EP | 1696182 | 8/2006 |
| JP | 2007-291877 | 11/2007 |
| KR | 10-0789817 B1 | 12/2007 |
| KR | 10-2013-0043980 | 5/2013 |

OTHER PUBLICATIONS

European Search Report dated Feb. 23, 2016.
(Continued)

*Primary Examiner* — Gregory L Huson
*Assistant Examiner* — Elizabeth M. May
(74) *Attorney, Agent, or Firm* — Ked & Associates LLP

(57) ABSTRACT

A centrifugal fan includes: an impeller; and a scroll housing surrounding the impeller, the scroll housing having suction hole and discharge hole formed therein. The scroll housing includes: a base plate; a scroll wall connected to the base plate, the scroll wall being formed in a scroll shape from a cutoff; and a discharge wall extending from the scroll wall. In the centrifugal fan, a flow path extending portion having a flow path sectional area extending toward an air flow direction convexly protrudes in the outer direction of the scroll housing in the base plate. Accordingly, a flow path is formed to extend in two directions including a direction in which the scroll wall extends and a direction in which the flow path extending portion protrudes. Thus, the static pressure of a discharge air current can be quickly recovered, and the blowing performance of the centrifugal fan can be improved. Further, the flow path extending portion is formed to protrude from the base plate, so that it is possible to enhance utilization of space near the flow path extending portion.

11 Claims, 11 Drawing Sheets

(51) Int. Cl.

| | |
|---|---|
| ***F04D 25/16*** | (2006.01) |
| ***F24F 1/0014*** | (2019.01) |
| ***F24F 1/0025*** | (2019.01) |
| ***F24F 1/0033*** | (2019.01) |
| ***F24F 1/0011*** | (2019.01) |
| ***F24F 1/005*** | (2019.01) |
| *F04D 25/10* | (2006.01) |
| *F04D 29/44* | (2006.01) |

(52) U.S. Cl.
CPC ..... *F04D 29/4246* (2013.01); *F24F 1/005* (2019.02); *F24F 1/0011* (2013.01); *F24F 1/0014* (2013.01); *F24F 1/0025* (2013.01); *F24F 1/0033* (2013.01); *F04D 25/10* (2013.01); *F04D 29/441* (2013.01)

(58) Field of Classification Search
USPC ..... 361/695; 415/215; 416/120
See application file for complete search history.

(56) References Cited

U.S. PATENT DOCUMENTS

| | | | | |
|---|---|---|---|---|
| 2004/0240994 | A1* | 12/2004 | Cole | F04D 29/4226 415/215.1 |
| 2006/0191279 | A1 | 8/2006 | Hong et al. | |
| 2007/0171613 | A1* | 7/2007 | McMahan | H05K 7/20736 361/695 |
| 2011/0150651 | A1* | 6/2011 | Zha | F04D 25/166 416/120 |

OTHER PUBLICATIONS

Chinese Office Action dated Mar. 9, 2018 issued in Application No. 201510053168.3 (with English translation).
European Search Report dated Sep. 26, 2017.

* cited by examiner

CENTRIFUGAL FAN AND AIR CONDITIONER HAVING THE SAME

BACKGROUND OF THE INVENTION

Field of the Invention

The present invention relates to a centrifugal fan and an air conditioner having the same and, more particularly, to a centrifugal fan in which air flows along a scroll wall, and an air conditioner having the same.

Related Art

In general, a centrifugal fan is a fan which blows air in the circumferential direction by the centrifugal force from the inside of an impeller (blades) by means of rotation of the impeller, and includes a sirocco fan, a turbo fan, and the like.

The sirocco fan, which has a plurality of short front curved wings (hereinafter, referred to as front curved blades), generates less noise, so it is commonly used in ventilation apparatuses or air-conditioners.

The sirocco fan may include an impeller having a plurality of front curved blades disposed therein, and a scroll housing surrounding the impeller. The scroll housing may include a bell mouse formed on at least one of left and right sides of the impeller to guide air suction.

The centrifugal fan may be installed in an air condition which allows air to be air-conditioned. The centrifugal fan may suck air in the interior of a room to flow the sucked air into an air-conditioning unit such as a heat exchanger or a filter. The air air-conditioned by the air-conditioning unit may be discharged to the interior of the room.

In KR 10-0789817 B1 (published on Dec. 31, 2007), there is disclosed a centrifugal fan inclined to have a gradient angle, of which the entire side extends to the exterior. The centrifugal fan has a problem in that the entire size of the centrifugal fan increases, and therefore, utilization of space near the centrifugal fan is low.

SUMMARY OF THE INVENTION

The present invention provides a centrifugal fan having improved blowing performance and high utilization of space therenear.

The present invention also provides an air conditioner having an impeller which can have high utilization of space near a centrifugal fan and become compact.

According to an aspect of the present invention, there is provided a centrifugal fan including: an impeller; and a scroll housing surrounding the impeller, the scroll housing having suction hole and discharge hole formed therein, wherein the scroll housing includes: a base plate; a scroll wall connected to the base plate, the scroll wall being formed in a scroll shape from a cutoff; and a discharge wall extending from the scroll wall, wherein a flow path extending portion having a flow path sectional area extending toward an air flow direction convexly protrudes in the outer direction of the scroll housing in the base plate.

The suction hole may be formed in a rear plate of the scroll housing, the discharge hole may be formed at an upper portion of the scroll housing, the base plate may be opposite to the rear plate, and the flow path extending portion may be formed to protrude in a front direction from the base plate.

The flow path sectional area of the flow path extending portion may gradually extend along the scroll wall and the discharge wall.

The flow path extending portion may start from the point at an angle of 180 degrees to 270 degrees from a reference angle.

The scroll housing may further include an inner discharge guide portion spaced apart from the flow path extending portion. The discharge hole may be formed between the flow path extending portion and the inner discharge guide portion.

According to another aspect of the present invention, there is provided an air conditioner having a centrifugal fan, the air conditioner including: a first discharge unit having a first discharge flow path formed therein; a second discharge unit having a second discharge flow path formed therein; a first centrifugal fan for blowing air to the second discharge flow path; and a second centrifugal fan having an air duct disposed at the front of the first centrifugal fan, wherein an air passage for guiding air into the first discharge flow path is formed between the air duct and the outer surface of the first centrifugal fan, wherein each of the first and second centrifugal fans includes: an impeller; and a scroll housing surrounding the impeller, the scroll housing having suction hole and discharge hole formed therein, wherein the scroll housing includes: a base plate; a scroll wall connected to the base plate, the scroll wall being formed in a scroll shape from an cutoff; and a discharge wall extending from the scroll wall, wherein a flow path extending portion having a flow path sectional area extending toward an air flow direction convexly protrudes in the outer direction of the scroll housing in the base plate.

The scroll housing of the second centrifugal fan may be positioned below the scroll housing of the first centrifugal fan.

The suction hole may be formed in a rear plate of the scroll housing, the discharge hole may be formed at an upper portion of the scroll housing, the base plate may be opposite to the rear plate, and the flow path extending portion may be formed to protrude in a front direction from the base plate.

The flow path sectional area of the flow path extending portion may gradually extend along the scroll wall and the discharge wall.

The flow path extending portion may start from the point at an angle of 180 degrees to 270 degrees from a reference angle.

The scroll housing may further include an inner discharge guide portion spaced apart from the flow path extending portion. The discharge hole may be formed between the flow path extending portion and the inner discharge guide portion.

The air duct may be disposed vertically long at the front of the first centrifugal fan.

The air duct may be positioned next to the flow path extending portion of the first centrifugal fan.

A start end of the flow path extending portion of the first centrifugal fan may be positioned at a point at a predetermined angle of 260 degrees to 280 degrees from the reference angle.

The section of the air duct may have a semicircular shape.

The lower end of the air duct may be positioned on the upper end of the flow path extending portion of the second centrifugal fan.

The air duct may be formed to protrude in an upper direction from the scroll housing of the second centrifugal fan.

The scroll housing of the first centrifugal fan may include an air guide surface opposite to the air duct.

A recessed guide portion opposite to the air duct may be formed in the scroll housing of the first centrifugal fan. The recessed guide portion may have an open upper end.

The impeller of the first centrifugal fan and the impeller of the second centrifugal fan may be rotated in the opposite directions to each other.

According to embodiments of the present invention, a flow path is formed to extend in two directions including a direction in which the scroll wall extends and a direction in which the flow path extending portion protrudes. Thus, the static pressure of a discharge air current can be quickly recovered, and the blowing performance of the centrifugal fan can be improved. Further, the flow path extending portion is formed to protrude from the base plate, so that it is possible to enhance utilization of space near the flow path extending portion.

Also, the second centrifugal fan is positioned below the first centrifugal fan, and air blown from the second centrifugal fan is guide between the outer surface of the first centrifugal fan and the air duct, so that it is possible to minimize the lateral and longitudinal widths of the air conditioner while allowing the first and second centrifugal fans to be vertically positioned.

Also, it is possible to minimize the space occupied by the first centrifugal fan and the air duct. Further, it is possible to enhance utilization of space near the space occupied by the first centrifugal fan and the air duct.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Figure 1:
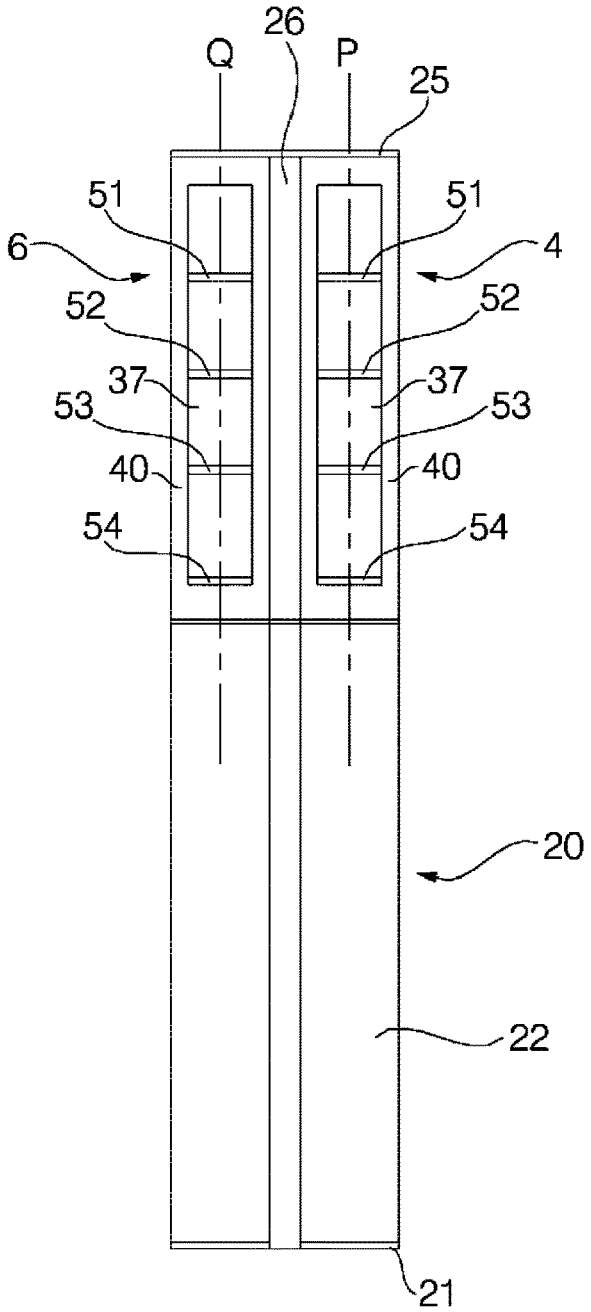
FIG. 1 is a plan view showing an air conditioner having a centrifugal fan according to an embodiment of the present invention.

Embodiments of the present invention to achieve the above-described objects will be described with reference to the accompanying drawings. In describing the present embodiment, the same elements are represented by the same reference numerals, and additional description will be omitted below.

Figure 2:
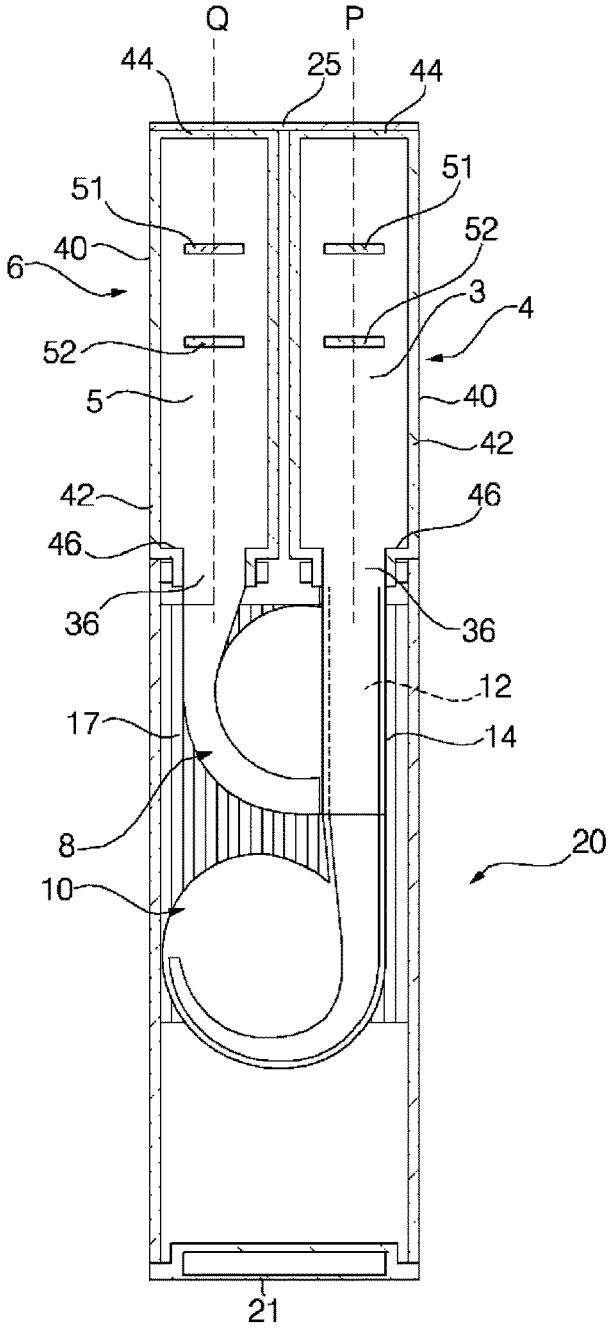
FIG. 2 is a front view showing the interior of the air conditioner having the centrifugal fan according to an embodiment of the present invention.
Figure 3:
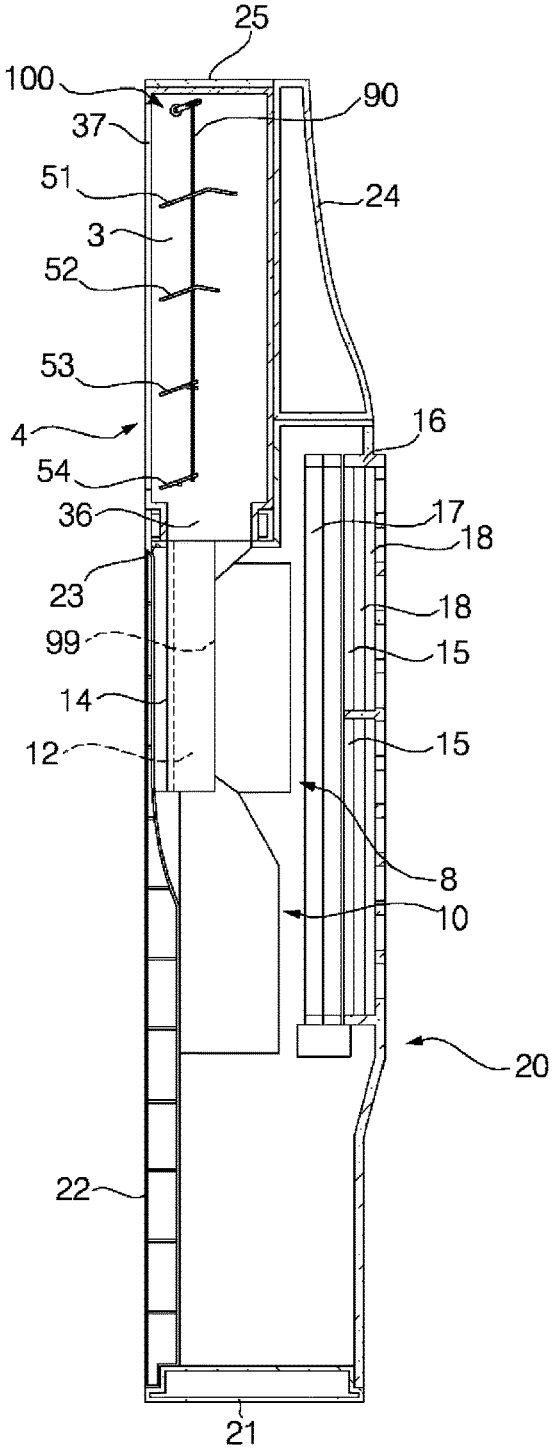
FIG. 3 is a side view showing the interior of the air conditioner having the centrifugal fan according to an embodiment of the present invention.
Figure 4:
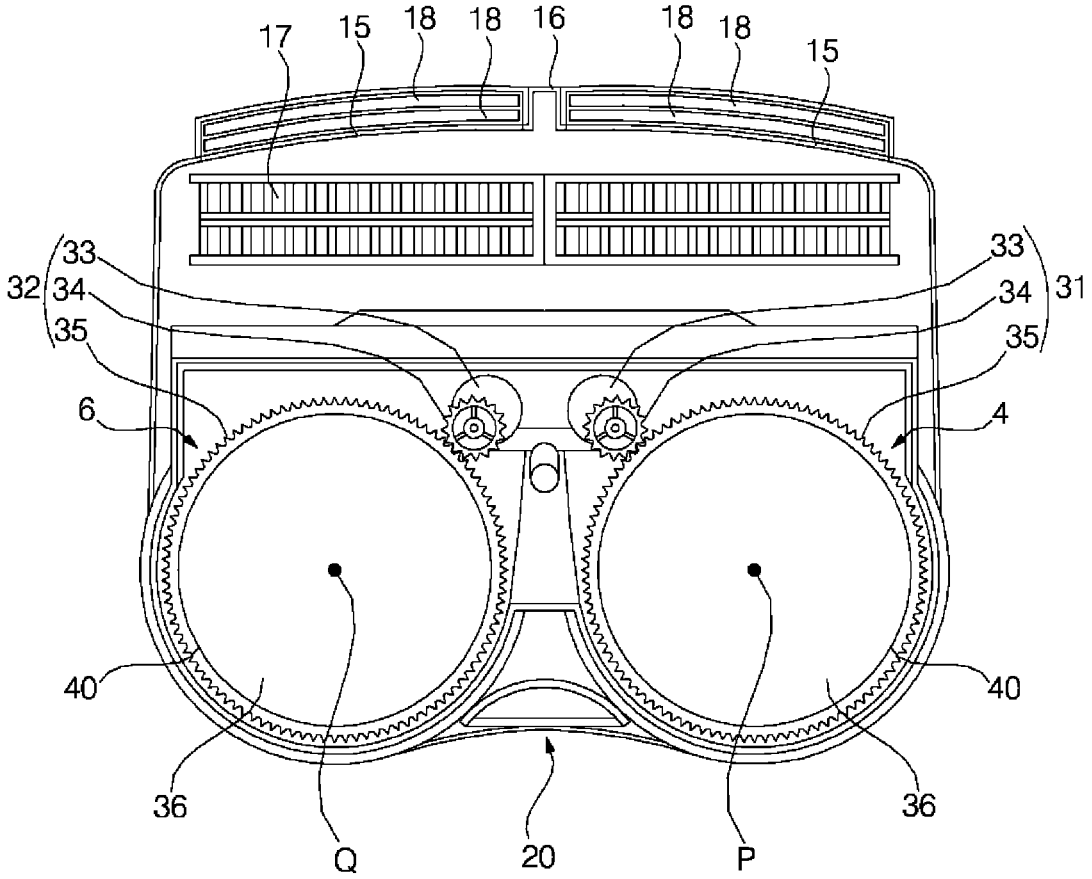
FIG. 4 is a cross-sectional view of the air conditioner having the centrifugal fan according to an embodiment of the present invention.
Figure 5:
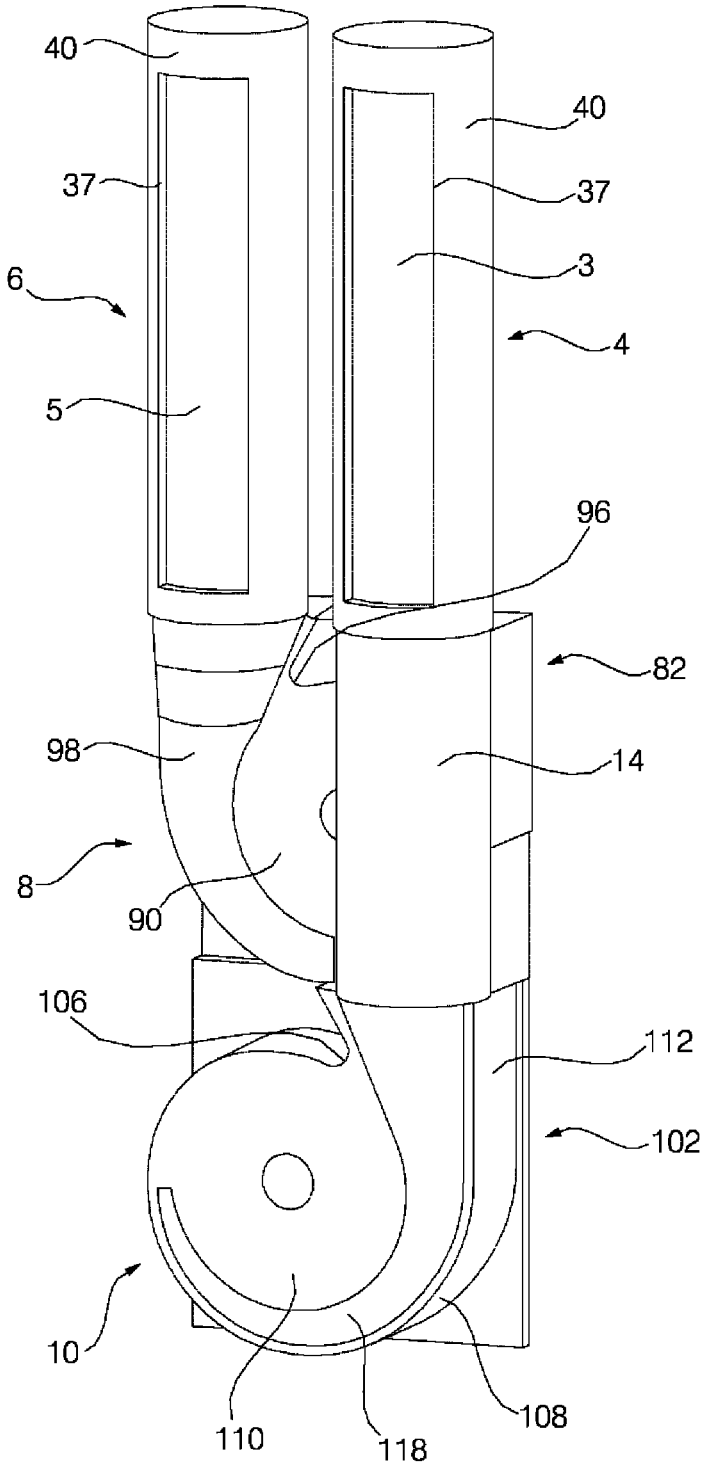
FIG. 5 is a perspective view showing first and second discharge units and first and second centrifugal fans the air conditioner having the centrifugal fan according to an embodiment of the present invention.

FIG. 1 is a plan view showing an air conditioner having a centrifugal fan according to an embodiment of the present invention. FIG. 2 is a front view showing the interior of the air conditioner having the centrifugal fan according to an embodiment of the present invention. FIG. 3 is a side view showing the interior of the air conditioner having the centrifugal fan according to an embodiment of the present invention. FIG. 4 is a cross-sectional view of the air conditioner having the centrifugal fan according to an embodiment of the present invention. FIG. 5 is a perspective view showing first and second discharge units and first and second centrifugal fans the air conditioner having the centrifugal fan according to an embodiment of the present invention.

The air conditioner having the centrifugal fan (hereinafter, referred to as the 'air conditioner') may include a first discharge unit 4 having a first discharge flow path 3 formed therein, and a second discharge unit 6 having a second discharge flow path 5 formed therein. The air conditioner may include at least one centrifugal fan.

The centrifugal fan includes an impeller; and a scroll housing surrounding the impeller, the scroll housing having a suction hole and a discharge hole.

The scroll housing includes a base plate; a scroll wall connected to the base plate, the scroll wall being formed in a scroll shape from a cutoff; and a discharge wall extending from the scroll wall.

In the base plate, a flow path extending portion having a flow path sectional area extending toward an air flow direction may convexly protrude in an outer direction of the scroll housing.

The suction hole may be formed in a rear plate of the scroll housing, and the discharge hole may be formed at an upper portion of the scroll housing. The base plate may be opposite to the rear plate, and the flow path extending portion may be formed to protrude in the front direction from the base plate.

The flow path sectional area of the flow path extending portion may gradually increase. The flow path extending portion may start from the point at a predetermined angle of 180 degrees to 270 degrees from a reference angle.

The scroll housing may further include an inner discharge guide portion spaced apart from the flow path extending portion, the inner discharge guide portion allowing the discharge hole formed between the same and the flow path extending portion.

The air conditioner may include a first centrifugal fan 8 for blowing air toward the second discharge flow path 5; and a second centrifugal fan 10 provided with an air duct 14 disposed at the front of the first centrifugal fan 8.

An air passage for guiding air toward the first discharge flow path 3 may be formed between the air duct 14 and an outer surface of the first centrifugal fan 8. The second centrifugal fan 10 may be positioned below the first centrifugal fan 8.

The first centrifugal fan 8 may act as an air blowing source for blowing air to the second discharge unit 6 and also act as an air guide for guiding air blown from the second centrifugal fan 10 to the first discharge unit 4.

The air conditioner may suck an air in the interior of a room to change the temperature or cleanliness of the air, and then discharge the air to the exterior through the first and second discharge units 4 and 6.

The air conditioner may include a suction body 16 into which air is sucked; and a heat exchanger 17 in which the air sucked into the suction body 16 is heat-exchanged with a refrigerant.

An air suction hole 15 may be formed in the suction body 16. The suction body 16 may be positioned at a rear portion of the air conditioner, and the first and second centrifugal fans 8 and 10 may suck air at the rear of the suction body 16 to allow the sucked air to pass through the heat exchanger 17.

An air cleaning unit 18 for cleaning air may be installed in the suction body 16. The air cleaning unit 18 may include a filter through which foreign matters in the air are filtered. The air cleaning unit 18 may include an electric dust collector for discharging and collecting foreign matters in the air. The air cleaning unit 18 may include an ion generator for generating ions in the air.

The heat exchanger 17 may be positioned posterior to the air suction hole 15 in an air flow direction. The heat exchanger 17 may be positioned prior to the first and second centrifugal fans 8 and 10 in the air flow direction.

The heat exchanger 17 may be provided to be positioned at the front of the suction body 16, and the air passing through the suction body 16 in the interior of a room may be sucked into at least one of the first and second centrifugal fans 8 and 10 by passing through the heat exchanger 17. The heat exchanger 17 may be vertically provided inside a case 20.

The air conditioner may include the case 20 forming an external appearance thereof.

The case 20 may include a base 21. The case 20 may include the suction body 16, and the suction body 16 may be disposed above the rear portion of the base 21.

The case 20 may further include a front panel 22 forming the external appearance of a front lower portion of the air conditioner. The front panel 22 may be disposed above the front portion of the base 21. The front panel 22 may cover the front of the first centrifugal fan 8 and the front of the second centrifugal fan 10.

The air conditioner may further include an upper plate 23 on which the first and second discharge units 4 and 6 are rotatably mounted. The upper plate 23 may be a discharge unit supporter which rotatably supports the first and second discharge units 4 and 6.

The air conditioner may further include a back cover 24 disposed above the rear portion of the upper plate 23, the back cover 24 being opposite to the rear portion of the first discharge unit 4 and the rear portion of the second discharge unit 6.

The air conditioner may include a top cover 25 covering the top surface of the first discharge unit 4 and the top surface of the second discharge unit 6. The top cover 25 may be provided to the back cover 24 to be positioned above the first and second discharge units 4 and 6.

The air conditioner may further include a partition wall 26 positioned between the first and second discharge units 4 and 6. The partition wall 26 may be disposed vertically long between the first and second discharge units 4 and 6. The left surface of the partition wall 26 may be opposite to a portion of the first discharge unit 4, and the right surface of the partition wall 26 may be opposite to a portion of the second discharge unit 6.

Each of the first and second discharge units 4 and 6 may be formed long in the vertical direction and rotatably disposed in the case 20. Each of the first and second discharge units 4 and 6 may rotate in left and right directions about a vertical center axis.

The air conditioner, as shown in FIG. 4, may include a first rotation mechanism 31 for rotating the first discharge unit 4; and a second rotation mechanism 32 for rotating the second discharge unit 6. The first rotation mechanism 31 may rotate the first discharge unit 4 about a first vertical center axis P. The second rotation mechanism 32 may rotate the second discharge unit 6 about a second vertical center axis Q. The first and second vertical center axes P and Q may be directed in upper and lower directions, respectively, and may be parallel with each other.

The first and second discharge units 4 and 6 may be rotated independently to each other. The first and second discharge units 4 and 6 may discharge air-conditioned air toward different regions in the interior of a room in which the air conditioner is installed.

When any one of the first and second discharge units 4 and 6 discharges the air-conditioned air toward a left region in the interior of the room, the other of the first and second discharge units 4 and 6 may discharge the air-conditioned air toward a right region in the interior of the room. Both the first and second discharge units 4 and 6 may discharge air toward the front of the air conditioner.

The first and second discharge units 4 and 6 may be positioned at an upper portion of the air conditioner. The first and second discharge units 4 and 6 may form the external appearance of a portion of the upper portion of the air conditioner. Any one of the first and second discharge units 4 and 6 may be the first discharge unit 4 positioned at a left side, and the other of the first and second discharge units 4 and 6 may be the second discharge unit 6 positioned at the right side of the first discharge unit 4. The first and second discharge units 4 and 6 may be positioned to be spaced apart from each other in the lateral direction. The first and second discharge units 4 and 6 may be configured to have different positions and the same structure.

The first and second discharge units 4 and 6 may have the same structure except that they are independently rotated by the first and second rotation mechanisms, respectively. Hereinafter, common components of the first and second discharge units 4 and 6 will be described as those of the discharge unit 4 or 6, and different components of the first and second discharge units 4 and 6 will be described by being divided into components of the first discharge unit 4 and components of the second discharge unit 6. In addition, common components of the first and second rotation mechanisms 31 and 32 will be described as those of the rotation mechanism 31 or 32, and different components of the first and second rotation mechanisms 31 and 32 will be described by being divided into components of the first rotation mechanism 31 and components of the second rotation mechanism 32.

The discharge unit 4 or 6 may include a discharge body 40 having a discharge flow path formed therein. An air inflow hole 36 may be formed at a lower portion of the discharge unit 4 or 6, and an air discharge hole 37 extending long in the vertical direction may be formed at a circumferential portion of the discharge unit 4 or 6. The discharge unit 4 or 6 may include the discharge body 40 having the air inflow hole 36 formed at a lower portion thereof and the air discharge hole 37, which extends long in the vertical direction, formed at the circumferential portion thereof. The air inflow hole 36 and the air discharge hole 37 may be open in directions perpendicular to each other in the discharge body 40. The air inflow hole 36 may be open in the vertical direction in the discharge body 40. The air discharge hole 37 may be open in the horizontal direction in the discharge body 40.

The discharge body 40 may include a hollow cylinder body 42 having the air discharge hole 37 formed therein, and a top plate 44 covering the top surface of the hollow cylinder body 42. The air inflow hole 36 may be formed to be open in the vertical direction at the lower portion of the discharge body 40. The air inflow hole 36 may be opposite to the top plate 44 in the vertical direction. The air inflow hole 36 may be formed at the lower end of the hollow cylinder body 42. The air inflow hole 36 may be formed to be open in the vertical direction in a bottom plate 46 disposed at a lower portion of the hollow cylinder body 42.

A discharge flow path through which air flowed through the air inflow hole 36 passes may be formed inside the hollow cylinder body 42. The discharge flow path may be long in the vertical direction. The discharge flow path may be formed by an inner circumferential surface of the hollow cylinder body 42.

The air blown in an upper direction in the case 20 may be blown into the hollow cylinder body 42 by passing through the air inflow hole 36 of the discharge body 40, and the air blown into the hollow cylinder body 42 may flow toward the air discharge hole 37 in the hollow cylinder body 42 to be discharged to the exterior through the air discharge hole 37.

The discharge unit 4 or 6 may further include a plurality of vanes 51, 52, 53 and 54 for adjusting the direction of air guided through the discharge body 40.

The plurality of vanes 51, 52, 53 and 54 guide the air passing through the discharge flow path in a state in which they are positioned inside the discharge body 40. The plurality of vanes 51, 52, 53 and 54 may be disposed to be spaced apart from one another in the vertical direction. The plurality of vanes 51, 52, 53 and 54 may be disposed in a line in the vertical direction. The discharge direction of the air contacted with the plurality of vanes 51, 52, 53 and 54 may be changed along the plurality of vanes 51, 52, 53 and 54, and the current of the air may be changed in a direction guided by the plurality of vanes 51, 52, 53 and 54.

The rotation mechanism 31 or 32 may includes a motor 33, a driving gear 34 connected to a rotational shaft of the motor 33, and a driven gear 35 formed in the discharge unit 4 or 6, the driven gear 35 being engaged with the driving gear 34.

The motor 33 may be provided in the air conditioner. The motor 33 may be a driving source which rotates the discharge unit 4 or 6. The motor 33 may be provided so that its rotational shaft protrudes upward. The motor 33 may be installed in the case 20. The motor 33 may be provided at one of the back cover 24 and the top cover 25. The motor 33 of the first rotation mechanism 31 and the motor 33 of the second rotation mechanism 32 may be driven at the same angle or speed. It will be apparent that the motor 33 of the first rotation mechanism 31 and the motor 33 of the second rotation mechanism 32 may be controlled at different angles or speeds.

The driving gear 34 may receive driving power of the motor 33 to transmit the received driving power to the driven gear 35. The driving gear 34 may be positioned between the motor 33 and the driven gear 35. The driving gear 34 may rotate the driven gear 35 when the motor 33 is driven.

The driven gear 35 may be formed in each of the first and second discharge units 4 and 6. When the motor 33 is driven, the driven gear 35 may be rotated by the driving gear 34 to rotate the discharge unit 4 or 6. The driven gear 35 of the first rotation mechanism 31 may be formed in the first discharge unit 4, and the driven gear 35 of the second rotation mechanism 32 may be formed in the second discharge unit 6.

The first centrifugal fan 8 may be provided to be positioned above the second centrifugal fan 10. The lateral and longitudinal widths of a space for installing both the first and second centrifugal fans 8 and 10 in the air conditioner can be minimized.

The amount of air from the first centrifugal fan 8 and the amount of air from the second centrifugal fan 10 may be controlled differently from each other. When the amount of air from the first centrifugal fan 8 is different from that of air from the second centrifugal fan 10, the temperature of air in an indoor region air-conditioned by the first centrifugal fan 8 and the second discharge unit 6 may be controlled differently from that of air in an indoor region air-conditioned by the second centrifugal fan 10 and the first discharge unit 4.

Figure 6:
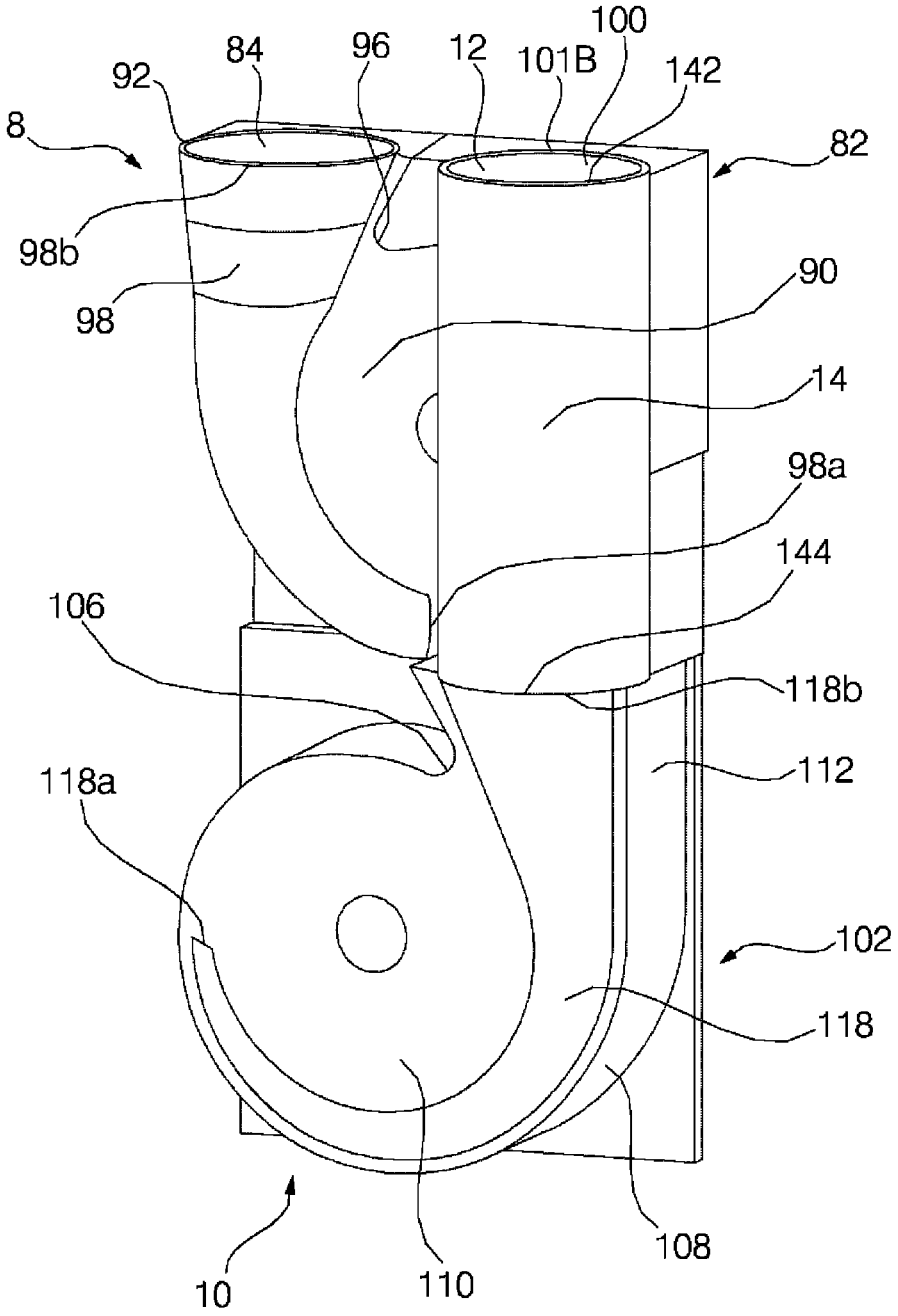
FIG. 6 is a perspective view showing the first and second centrifugal fans shown in FIG. 5.
Figure 7:
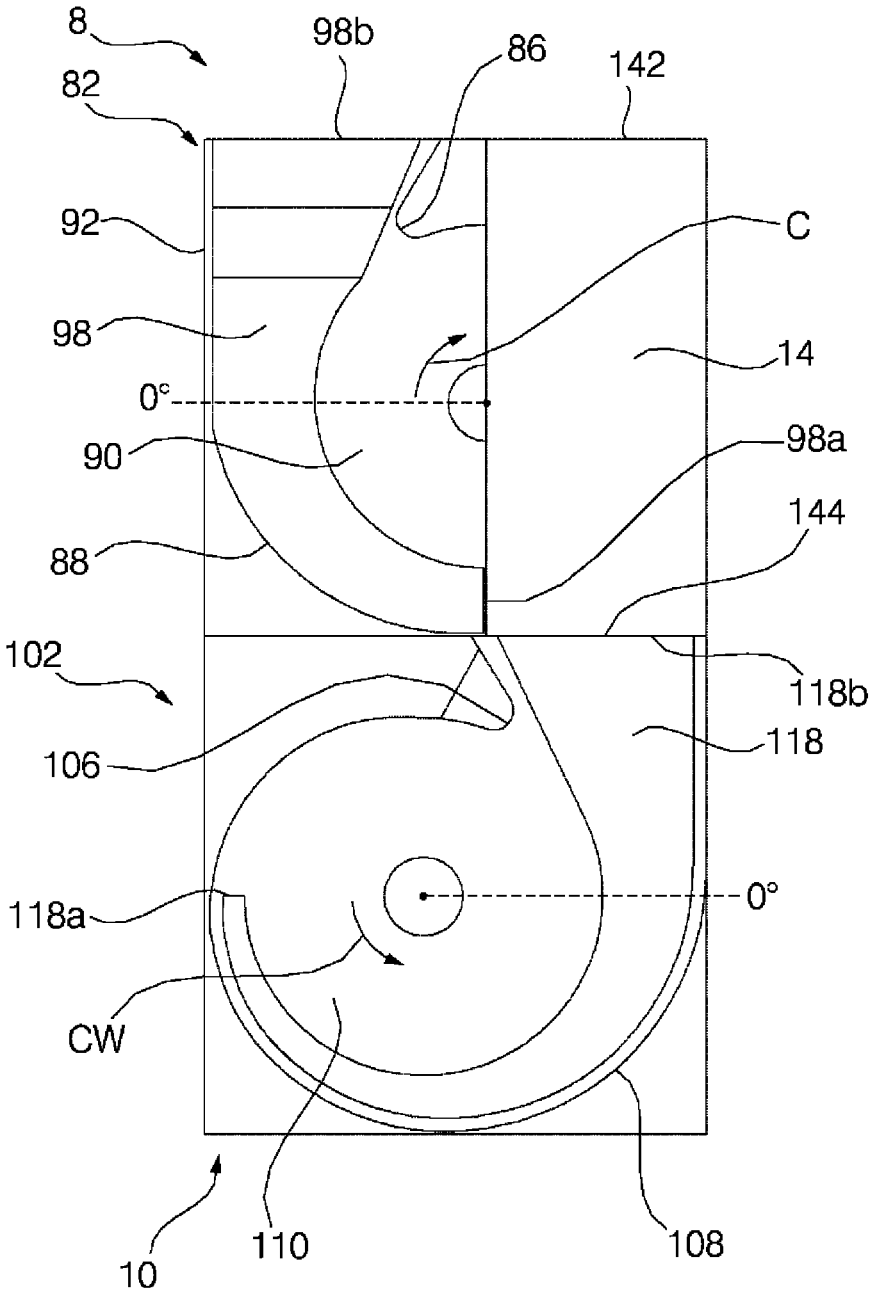
FIG. 7 is a front view showing the first and second centrifugal fans shown in FIG. 5.
Figure 8:
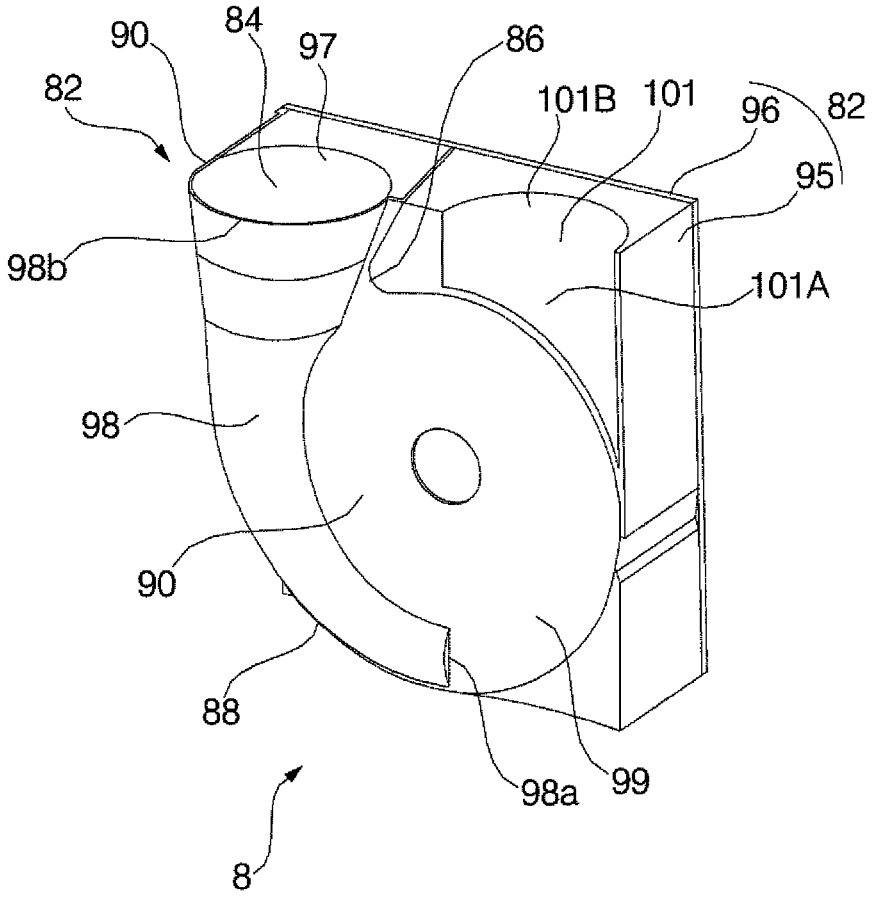
FIG. 8 is a perspective view showing a scroll housing of the first centrifugal fan shown in FIG. 5.
Figure 9:
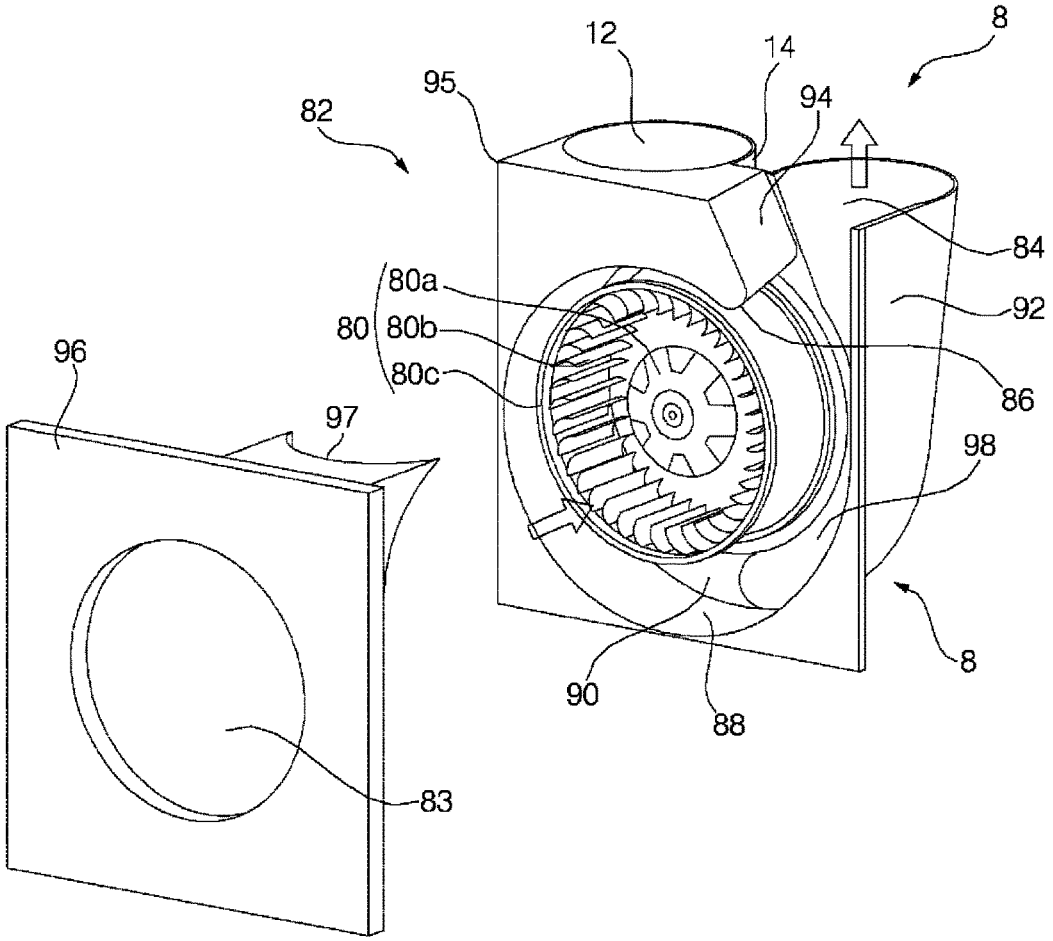
FIG. 9 is an exploded perspective view when the first centrifugal fan shown in FIG. 5 is viewed from the rear thereof.
Figure 10:
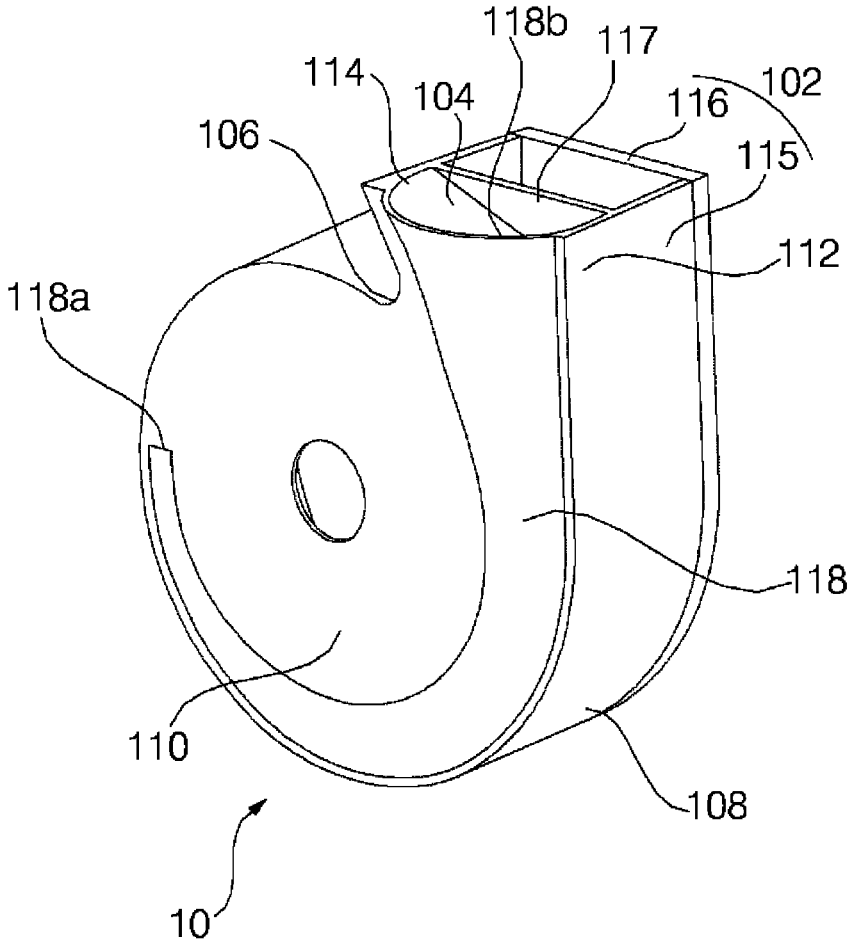
FIG. 10 is a perspective showing the scroll housing of the first centrifugal fan shown in FIG. 5.
Figure 11:
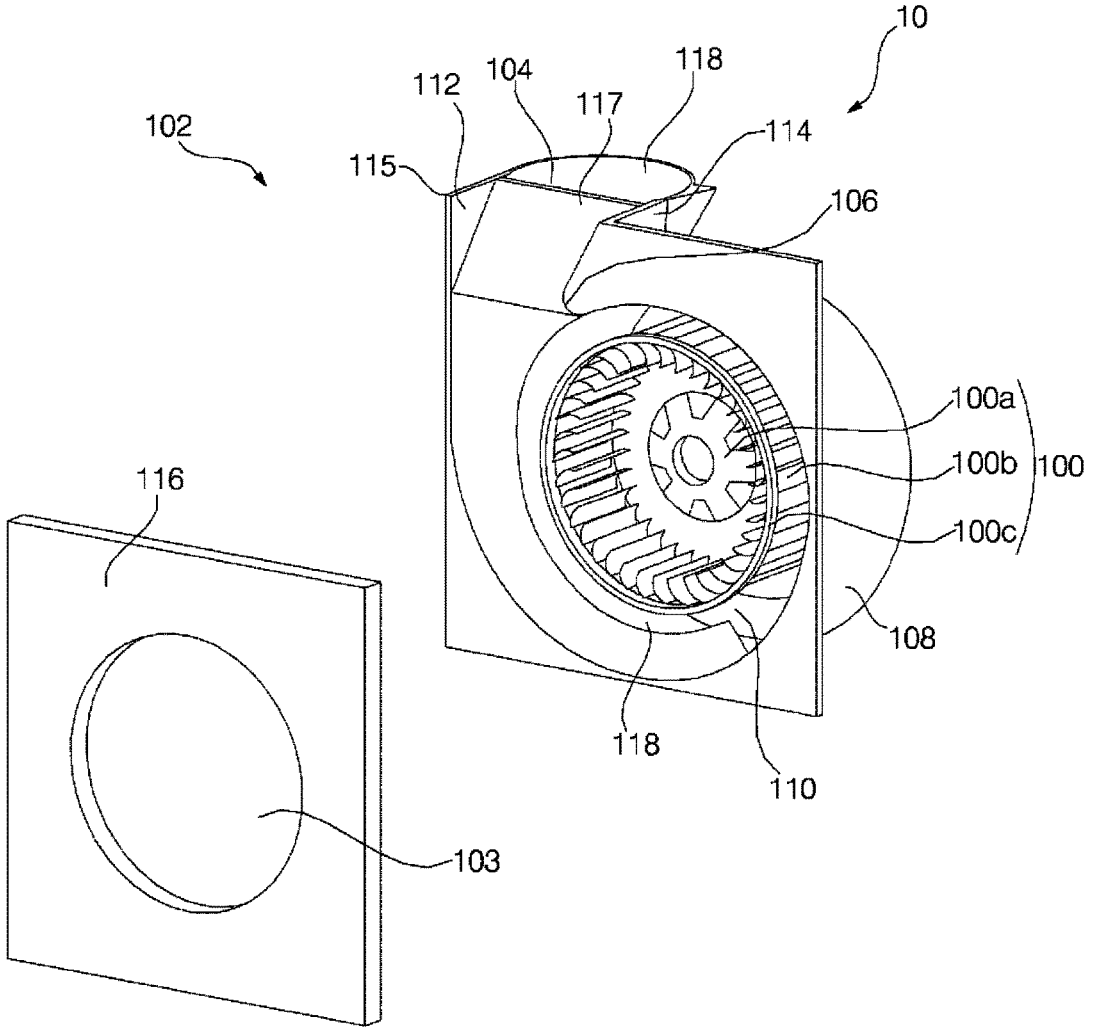
FIG. 11 is an exploded perspective view when the second centrifugal fan shown in FIG. 5 is viewed from the rear thereof.

FIG. 6 is a perspective view showing the first and second centrifugal fans shown in FIG. 5. FIG. 7 is a front view showing the first and second centrifugal fans shown in FIG. 5. FIG. 8 is a perspective view showing a scroll housing of the first centrifugal fan shown in FIG. 5. FIG. 9 is an exploded perspective view when the first centrifugal fan shown in FIG. 5 is viewed from the rear thereof. FIG. 10 is a perspective showing the scroll housing of the first centrifugal fan shown in FIG. 5. FIG. 11 is an exploded perspective view when the second centrifugal fan shown in FIG. 5 is viewed from the rear thereof.

The first centrifugal fan 8 includes an impeller 80; and a scroll housing 82 surrounding the impeller 80.

The impeller 80 of the first centrifugal fan 8 may be configured with as a blower of a sirocco fan. The impeller 80 of the first centrifugal fan 8, as shown in FIG. 9, may include a main plate 80*a*, a plurality of blades 80*b* formed on the main plate 80*a*, and a rim 80*c* for connecting the plurality of blades 80*b*.

The first centrifugal fan 8 may include a first motor (not shown) having a rotational shaft connected to the impeller 80 to rotate the impeller 80. The rotational shaft of the first motor may be horizontally provided. The first motor may be mounted in the scroll housing 82 of the first centrifugal fan 8 or the case 20. When the first motor is driven, the impeller 80 of the first centrifugal fan 8 may be rotated by the first motor to flow air, and the air flowed in the rotation of the impeller 80 may be guided to the scroll housing 82 of the first centrifugal fan 8 to be blown into the second discharge unit 6.

The scroll housing 82 of the first centrifugal fan 8 may have a suction hole 83 and a discharge hole 84, formed therein, and the suction hole 83 and the discharge hole 84 may be open in different directions.

The scroll housing 82 of the first centrifugal fan 8 includes a base plate 90, and a scroll wall 88 formed in a scroll shape from a cutoff 86. The scroll wall 88 may be connected to the base plate 90. The scroll wall 88 may be connected perpendicular to the base plate 90. The scroll housing 82 of the first centrifugal fan 8 may include a discharge wall 92 extending from the scroll wall 88. The scroll wall 88 of the first centrifugal fan 8 may extend to be distant from the impeller 80 as becoming closer to the discharge wall 92. The discharge wall 92 of the first centrifugal fan 8 may extend in an upper direction from the point at which the scroll wall 88 terminates in the air flow direction. The discharge wall 92 of the first centrifugal fan 8 forms the discharge hole 84. The discharge wall 92 of the first centrifugal fan 8 may be formed in the shape of a quadrangular plate body. The scroll housing 82 of the first centrifugal fan 8 is formed in a shape bent from the cutoff 68, and may further include a discharge guide 94 allowing the discharge hole 84 formed between the same and the discharge wall 92 of the first centrifugal fan 8.

The discharge guide 94 may be formed to be gradually distant from the discharge wall 92 as becoming closer to the top thereof.

The scroll housing 82 of the first centrifugal fan 8 may further include a suction plate 96 having the suction hole 83 formed therein. The suction hole 83 of the first centrifugal fan 8 may be formed in a bell-mouth shape.

The scroll housing 82 of the first centrifugal fan 8 may include a housing body 95 in which the cutoff 86, the scroll wall 88, the base plate 90 and the discharge wall 92 are formed, and the suction plate 96 coupled to the housing body 95. The discharge guide 94 may be formed at the housing body 95 or the suction plate 96.

In the scroll housing 82 of the first centrifugal fan 8, the suction plate 96 may be mounted at the rear surface of the housing body 95. The suction plate 96 may constitute a rear plate of the scroll housing 82.

The base plate 90 of the first centrifugal fan 8 may be a plate opposite to the suction hole 83 of the first centrifugal fan 8. The base plate 90 of the first centrifugal fan 8 may constitute a front plate of the scroll housing 82. The impeller 80 of the first centrifugal fan 8 may be rotated about a horizontal center axis between the base plate 90 and the suction plate 96 in the first centrifugal fan 8.

In the base plate 90 of the first centrifugal fan 8, a flow path extending portion 98 having a flow path sectional area extending toward an air flow direction may convexly protrude in an outer direction of the scroll housing 82. Here, the air flow direction may be a direction in which the air flowed by the impeller 80 of the first centrifugal fan 8 flows in the discharge hole 84 along the inner surface of the scroll wall 88 and the inner surface of the discharge wall 92.

The suction hole 83 of the first centrifugal fan 8 may be formed in the rear plate of the scroll housing 82, and the discharge hole 84 of the first centrifugal fan 8 may be formed at an upper portion of the scroll housing 82. The base plate 90 of the first centrifugal fan 8 may be a front plate opposite to the rear plate.

The flow path extending portion 98 of the first centrifugal fan 8 may be formed to protrude in a front direction from the base plate 90. The flow path extending portion 98 of the first centrifugal fan 8 may be formed so that its flow path sectional area gradually extends along the scroll wall 88 and the discharge wall 92. The flow path extending portion 98 of the first centrifugal fan 8 may be formed so that its flow path sectional area gradually increases as becoming closer to the discharge hole 84 of the first centrifugal fan 8.

The flow path extending portion 98 of the first centrifugal fan 8, as shown in FIG. 7, may start from the point at a predetermined angle of 150 degrees to 300 degrees in the rotational direction of the impeller 80 from a reference angle (0 degree). The flow path extending portion 98 of the first centrifugal fan 8 may be formed up to the discharge hole 84. Here, the reference angle (0 degree) may be a boundary at which the scroll wall 88 of the first centrifugal fan 8 meets the discharge wall 92 of the first centrifugal fan 8. The flow path extending portion 98 of the first centrifugal fan 8 may have a gradually extending flow path sectional area while starting from the point at a predetermined angle of 260 degrees to 280 degrees from the reference angle (0 degree), in consideration of the position of the air duct 14. The upper end of the flow path extending portion 98 of the first centrifugal fan 8 may be largest. That is, a start end 98*a* of the flow path extending portion 98 of the first centrifugal fan 8 may be positioned at the point at the predetermined angle of 260 degrees to 280 degrees from the reference angle (0 degree), and the flow path sectional area of an upper end 98*b* of the flow path extending portion 98 may be largest.

The base plate 90 of the first centrifugal fan 8 is not formed so that it is entirely inclined but may be formed so that only the flow path extending portion 98 protrudes forward. The flow path extending portion 98 of the first centrifugal fan 8 may be formed in a shape rounded in only a partial region close to the scroll wall 88 and the discharge wall 92 in the base plate 90 of the first centrifugal fan 8. Accordingly, it is possible to enhance utilization of space near the flow path extending portion 98 of the first centrifugal fan 8, as compared with when the base plate 90 is formed so that it is entirely inclined to a predetermined angle. Further, it is possible to install the air duct 14 and the first centrifugal fan 8 as compact as possible.

Meanwhile, the first centrifugal fan 8, as shown in FIGS. 8 and 9, may further include an inner discharge guide portion 97 disposed inside the scroll hosing 82 of the first centrifugal fan 8. The inner discharge guide portion 97 is spaced apart from the flow path extending portion 98 of the first centrifugal fan 8, and may allow the discharge hole 84 formed between the same and the flow path extending portion 98.

The second centrifugal fan 10 includes an impeller 100; and a scroll housing 102 surrounding the impeller 100.

The impeller 100 of the second centrifugal fan 10 may be configured with as a blower of a sirocco fan. The impeller 100 of the second centrifugal fan 10, as shown in FIG. 11, may include a main plate 100*a*, a plurality of blades 100*bb* formed on the main plate 100*a*, and a rim 100*c* for connecting the plurality of blades 100*b*.

The second centrifugal fan 10 may include a second motor (not shown) having a rotational shaft connected to the impeller 100 to rotate the impeller 100. The rotational shaft of the second motor may be horizontally provided. The second motor may be mounted in the scroll housing 102 of the second centrifugal fan 10 or the case 20. When the second motor is driven, the impeller 100 of the second centrifugal fan 10 may be rotated by the second motor to flow air, and the air flowed in the rotation of the impeller 100 may be guided to the scroll housing 102 of the second centrifugal fan 10 to be blown into the air passage 12.

The scroll housing 102 of the second centrifugal fan 10 may have a suction hole 103 and a discharge hole 104, formed therein, and the suction hole 103 and the discharge hole 104 may be open in different directions.

The scroll housing 102 of the second centrifugal fan 10 includes a base plate 110, and a scroll wall 108 formed in a scroll shape from a cutoff 106. The scroll wall 108 may be connected to the base plate 110. The scroll wall 108 may be connected perpendicular to the base plate 110 of the second centrifugal fan 10. The scroll housing 102 of the second centrifugal fan 10 may include a discharge wall 112 extending from the scroll wall 108. The scroll wall 108 of the second centrifugal fan 10 may extend to be distant from the impeller 100 as becoming closer to the discharge wall 112. The discharge wall 112 of the second centrifugal fan 10 may extend in an upper direction from the point at which the scroll wall 108 terminates in the air flow direction. The discharge wall 112 of the second centrifugal fan 10 forms the discharge hole 104. The discharge wall 112 of the second centrifugal fan 10 may be formed in the shape of a quadrangular plate body. The scroll housing 102 of the second centrifugal fan 10 is formed in a shape bent from the cutoff 106, and may further include a discharge guide 114 allowing the discharge hole 104 formed between the same and the discharge wall 112 of the second centrifugal fan 10. The discharge guide 114 may be formed to be gradually distant from the discharge wall 112 as becoming closer to the top thereof.

The scroll housing 102 of the second centrifugal fan 10 may further include a suction plate 116 having the suction hole 103 formed therein. The suction hole 103 of the second centrifugal fan 10 may be formed in a bell-mouth shape.

The scroll housing 102 of the second centrifugal fan 10 may include a housing body 115 in which the cutoff 106, the scroll wall 108, the base plate 110 and the discharge wall 112 are formed, and the suction plate 116 coupled to the housing body 115. The discharge guide 114 may be formed at the housing body 115 or the suction plate 116. In the scroll housing 102 of the second centrifugal fan 10, the suction plate 116 may be mounted at the rear surface of the housing body 115. The suction plate 116 may constitute a rear plate of the scroll housing 102.

The base plate 110 of the second centrifugal fan 10 may be a plate opposite to the suction hole 103 of the second centrifugal fan 10. The base plate 110 of the second centrifugal fan 10 may constitute a front plate of the scroll housing 102. The impeller 100 of the second centrifugal fan 10 may be rotated about a horizontal center axis between the base plate 110 and the suction plate 116 in the second centrifugal fan 10.

In the base plate 110 of the second centrifugal fan 10, a flow path extending portion 118 having a flow path sectional area extending toward an air flow direction may convexly protrude in an outer direction of the scroll housing 102. Here, the air flow direction may be a direction in which the air flowed by the impeller 100 of the second centrifugal fan 10 flows along the inner surface of the scroll wall 108 and the inner surface of the discharge wall 112.

The suction hole 103 of the second centrifugal fan 10 may be formed in the rear plate of the scroll housing 102, and the discharge hole 104 of the second centrifugal fan 10 may be formed at an upper portion of the scroll housing 102. The base plate 110 of the second centrifugal fan 10 may be a front plate opposite to the rear plate.

The flow path extending portion 118 of the second centrifugal fan 10 may be formed to protrude in a front direction from the base plate 110. The flow path extending portion 118 of the second centrifugal fan 10 may be formed so that its flow path sectional area gradually extends along the scroll wall 108 and the discharge wall 112. The flow path extending portion 118 of the second centrifugal fan 10 may be formed so that its flow path sectional area gradually increases as becoming closer to the discharge hole 104 of the second centrifugal fan 10.

The flow path extending portion 118 of the second centrifugal fan 10, as shown in FIG. 7, may start from the point at a predetermined angle of 150 degrees to 300 degrees in the rotational direction of the impeller 100 from a reference angle (0 degree). The flow path extending portion 118 of the second centrifugal fan 10 may be formed up to the discharge hole 104. Here, the reference angle (0 degree) may be a boundary at which the scroll wall 108 of the second centrifugal fan 10 meets the discharge wall 112 of the second centrifugal fan 10. The flow path extending portion 118 of the second centrifugal fan 10 may have a gradually extending flow path sectional area while starting from the point at a predetermined angle of 170 degrees to 190 degrees from the reference angle (0 degree). That is, a start end 118*a* of the flow path extending portion 118 of the second centrifugal fan 10 may be positioned at the point at the predetermined angle of 170 degrees to 190 degrees from the reference angle (0 degree), and the flow path sectional area of an upper end 118*b* of the flow path extending portion 118 may be largest.

The base plate 110 of the second centrifugal fan 10 is not formed so that it is entirely inclined but may be formed so that only the flow path extending portion 118 protrudes forward. The flow path extending portion 118 of the second centrifugal fan 10 may be formed in a shape rounded in only a partial region close to the scroll wall 108 and the discharge wall 112 in the base plate 110 of the second centrifugal fan 10. Accordingly, it is possible to enhance utilization of space near the flow path extending portion 118 of the second centrifugal fan 10, as compared with when the base plate 110 is formed so that it is entirely inclined to a predetermined angle.

The first centrifugal fan 10, as shown in FIG. 11, may further include an inner guide plate portion 117 disposed inside the scroll hosing 102 of the second centrifugal fan 10. The inner guide plate portion 117 is spaced apart from the flow path extending portion 118 of the second centrifugal fan 10, and may allow the discharge hole 104 formed between the same and the flow path extending portion 118.

In the second centrifugal fan 10, the rotational direction of the impeller 80 may be opposite to that of the impeller 100 in the first centrifugal fan 8. When the impeller 80 of the first centrifugal fan 8 is rotated clockwise C, the impeller 100 of the second centrifugal fan 10 may be rotated counterclockwise CW. The flow path extending part 98 of the first centrifugal fan 8 may be positioned beneath the second discharge unit 6, and the air duct 14 may be positioned beneath the first discharge unit 4. The flow path extending portion 118 of the second centrifugal fan 10 may be positioned beneath the air duct 14.

The scroll housing 102 of the second centrifugal fan 10 may be positioned lower than the scroll housing 82 of the first centrifugal fan 8. The height of the scroll housing 102 of the second centrifugal fan 10 may be provided lower than that of the scroll housing 82 of the first centrifugal fan 8. The air duct 14 may be positioned at the front of the scroll housing 82 of the first centrifugal fan 8.

The air duct 14 may act as an air guide for guiding, to the first discharge unit 4, air blown from the second centrifugal fan 10 together with the first centrifugal fan 8.

The air duct 14 may be disposed vertically long between the first discharge unit 4 and the discharge hole 104 of the second centrifugal fan 10. The horizontal section of the air duct 14 may have a semicircular shape.

The air duct 14 may have an upper end 142 positioned beneath the first discharge unit 4. A partial upper portion of the air duct 14 may be inserted into the air inflow hole 36 of the first discharge unit 4. The air duct 14 and the first discharge unit 4 may communicate with each other through a separate connector (not shown) positioned therebetween. The first discharge unit 4 may be rotatably connected to the connector, and a partial upper portion of the air duct 14 may be connected to the connector.

The air duct 14 may has a lower end 144 positioned on the upper end 118*b* of the flow path extending portion 118 of the second centrifugal fan 10.

After the air duct 14 is manufactured separately from the scroll housing 102 of the second centrifugal fan 10, the air duct 14 may be coupled to the scroll housing 82 of the first centrifugal fan 8 to be positioned above the flow path extending part 118.

The air duct 14 may be integrally formed with the scroll housing 102 of the second centrifugal fan 10. The air duct 14 may be formed to protrude upward from the scroll housing 102 of the second centrifugal fan 10.

The air blown upward from the flow path extending portion 118 of the second centrifugal fan 10 may be flowed between the inner circumferential surface of the air duct 14 and a partial outer surface of the scroll housing 82 of the first centrifugal fan 8.

The scroll housing 82 of the first centrifugal fan 8 may include an air guide surface 99 opposite to the air duct 14. Here, the air guide surface 99, as shown in FIG. 8, may be a portion of the base plate 90 covered by the air duct 14 in the base plate 90 of the first centrifugal fan 8. At least a portion of the air guide surface 99 may be formed in a planar shape, and the air blown from the second centrifugal fan 10 may be guided while passing between the inner circumferential curved surface of the air duct 14 and the plane of the air guide surface 99.

A recessed guide portion 101 opposite to the air duct 14 may be formed in the scroll housing 82 of the first centrifugal fan 8. The recessed guide portion 101 may an open upper end. The recessed guide portion 101 may be opposite, together with the air guide surface 99, to the air duct 14. The air guide surface 99 may be opposite to a lower portion of the air duct 14, and the air guided by the air guide surface 99 is flowed into the recessed guide portion 101, to be guided by the recessed guide portion 101. The recessed guide portion 101 may include a lower guide portion 101A having a flow path sectional area which increases as becoming closer to the top thereof. The recessed guide portion 101 may have an open upper end 101B.

The left and right rear ends of the air duct 14 may be provided to come in contact with the base plate 90 of the first centrifugal fan 8. Each of the left and right rear ends of the air duct 14 may be provided to be positioned next to the flow path extending portion 98 of the first centrifugal fan 8.

Hereinafter, the operation of the present invention configured as described above will be described as follows.

First, when the first centrifugal fan 8 is driven, air in the interior of a room may be sucked through the air suction hole 15, and may be cleaned by the air cleaning unit 18. The air may be flowed into the heat exchanger 17 to be heat-exchanged with the heat exchanger 17. Then, the air may be sucked into the suction hole 83 of the first centrifugal fan 8. The air sucked into the suction hole 83 of the first centrifugal fan 8 may be flowed in the rotational direction of the impeller 80 of the first centrifugal fan 8 by the impeller 80 of the first centrifugal fan 8. As the air is flowed to extend in two directions along the scroll wall 88 and the flow path extending portion 98 of the first centrifugal fan 8, the static pressure of the air may be recovered. The air may be discharged into the discharge hole 84 of the first centrifugal fan 8 while being guided by the discharge wall 92 and the flow path extending portion 98 of the first centrifugal fan 8. The air discharged into the discharge hole 84 of the first centrifugal fan 8 may be blown into the second discharge unit 5 of the second discharge unit 6. The air may be discharged into the interior of the room by passing through the first discharge unit 4.

When the second centrifugal fan 10 is driven, air in the interior of the room may be sucked through the air suction hole 15, and may be cleaned by the air cleaning unit 18. The air may be flowed into the heat exchanger 17 to be heat-exchanged with the heat exchanger 17. Then, the air may be sucked into the suction hole 103 of the second centrifugal fan 10. The air sucked into the suction hole 103 of the second centrifugal fan 10 may be flowed in the rotational direction of the impeller 100 of the second centrifugal fan 10 by the impeller 100 of the second centrifugal fan 10. As the air is flowed to extend in two directions along the scroll wall 108 and the flow path extending portion 118 of the second centrifugal fan 10, the static pressure of the air may be recovered. The air may be discharged into the discharge hole 104 of the second centrifugal fan 10 while being guided by the discharge wall 112 and the flow path extending portion 118 of the second centrifugal fan 10. The air discharged into the discharge hole 104 of the second centrifugal fan 10 may be blown into the air passage 12 between the first centrifugal fan 8 and the air duct 14. The air blown into the air passage 12 from the second centrifugal fan 10 may be flowed into the first discharge flow path 3 of the first discharge unit 4 by passing through the air passage 12. The air flowed into the first discharge flow path 3 may be discharged to the exterior from the first discharge unit 4.

In the operation of the air conditioner, the amount of air from the first centrifugal fan 8 may be different from that of air from the second centrifugal fan 10. For example, the first centrifugal fan 8 may be driven with a large amount of air, and the second centrifugal fan 10 may be driven with a small amount of air. The air discharge hole 37 of the first discharge unit 4 may face any one of the front direction, the inclination direction of the front right and the right direction, and the air discharge hole 37 of the second discharge unit 6 may face any one of the front direction, the inclination direction of the front left and the right direction. In this case, the air conditioner may discharge a larger amount of cold air to a right region in the interior of the room based on the center in the interior of the room, and the right region in the interior of the room may be air-conditioned to a temperature lower than that of the right region in the interior of the room.

While the present invention has been shown and described in connection with the embodiments, it will be apparent to those skilled in the art that modifications and variations can be made without departing from the spirit and scope of the invention as defined by the appended claims.

What is claimed is:

1. A discharge device for an air conditioner having a centrifugal fan, comprising:

a first discharge unit having a first discharge flow path formed therein;

a second discharge unit having a second discharge flow path formed therein;

a first centrifugal fan for blowing air to the second discharge flow path; and a second centrifugal fan having an air duct disposed at a front of the first centrifugal fan, wherein an air passage for guiding air into the first discharge flow path is formed between the air duct and an outer surface of the first centrifugal fan, wherein each of the first and second centrifugal fans includes:

an impeller; and a scroll housing surrounding the impeller, the scroll housing having a suction hole and a discharge hole formed therein, wherein the scroll housing includes:

a base plate;

a rear plate having the suction hole formed therein;

a scroll wall connected to the base plate and the rear plate, the scroll wall being formed in a scroll shape from an cutoff; and a discharge wall extending from the scroll wall, wherein a flow path extending portion having a flow path sectional area extends in an air flow direction, wherein the flow path extending portion convexly protrudes in a frontward direction of the scroll housing at the base plate, wherein the scroll wall is connected perpendicularly to the base plate and the rear plate, wherein the flow path extending portion protrudes in a rounded shape from an edge of the base plate in contact with the scroll wall towards a center of the base plate along a predetermined section of the scroll wall, wherein a first discharge hole disposed downstream from the second discharge flow path is formed at an upper portion of the scroll housing of the first centrifugal fan, wherein a horizontal section of the air duct has a semicircular shape, wherein the scroll housing of the first centrifugal fan includes an air guide surface opposite to the air duct, wherein the air guide surface is a portion of the base plate of the first centrifugal fan and formed in a planar shape, wherein a recessed guide portion is formed at the upper portion of the scroll housing of the first centrifugal fan, and has an open upper end, wherein the air passage is formed between the air duct and the air guide surface and between the air duct and the recessed guide portion, and wherein the first discharge hole and an upper portion of the air passage are disposed adjacent to each other in a lateral direction at the upper portion of the scroll housing of the first centrifugal fan.

2. The discharge device for an air conditioner of claim 1, wherein the scroll housing of the second centrifugal fan is positioned below the scroll housing of the first centrifugal fan.

3. The discharge device for an air conditioner of claim 1, wherein the flow path sectional area of the flow path extending portion gradually extends along the scroll wall and the discharge wall.

4. The discharge device for an air conditioner of claim 1, wherein the flow path extending portion starts from the point at an angle of 180 degrees to 270 degrees from a reference angle.

5. The discharge device for an air conditioner of claim 1, wherein the scroll housing further includes an inner discharge guide portion spaced apart from the flow path extending portion, and wherein the discharge hole is formed between the flow path extending portion and the inner discharge guide portion.

6. The discharge device for an air conditioner of claim 1, wherein the air duct is disposed vertically long at the front of the first centrifugal fan.

7. The discharge device for an air conditioner of claim 1, wherein the air duct is positioned next to the flow path extending portion of the first centrifugal fan.

8. The discharge device for an air conditioner of claim 7, wherein a start end of the flow path extending portion of the first centrifugal fan is positioned at a point at a predetermined angle of 260 degrees to 280 degrees from the reference angle.

9. The discharge device for an air conditioner of claim 1, wherein a lower end of the air duct is positioned on an upper end of the flow path extending portion of the second centrifugal fan.

10. The discharge device for an air c conditioner of claim 1, wherein the air duct is formed to protrude in an upward direction from the scroll housing of the second centrifugal fan.

11. The discharge device for an air conditioner of claim 1, wherein the impeller of the first centrifugal fan and the impeller of the second centrifugal fan are rotated in the opposite directions to each other.

* * * * *